US005237805A

United States Patent [19]

Menegatto

[11] Patent Number: 5,237,805

[45] Date of Patent: Aug. 24, 1993

[54] YARN TWISTING MACHINE CONTROL APPARATUS HAVING A SIMPLIFIED CONTROL PANEL AND A YARN TWISTING MACHINE EQUIPPED THEREWITH

[76] Inventor: Carlo Menegatto, Via Spreafico No 10, Monza, Milano, Italy

[21] Appl. No.: 735,271

[22] Filed: Jul. 24, 1991

[30] Foreign Application Priority Data

Mar. 2, 1990 [IT] Italy ..... 21174 A/90

[51] Int. Cl.[5] ..... D02G 3/36

[52] U.S. Cl. ..... 57/16; 57/264

[58] Field of Search ..... 57/13, 15, 16, 18, 93, 57/100, 264, 265

[56] References Cited

U.S. PATENT DOCUMENTS

| | | | |
|---|---|---|---|
| 2,706,376 | 4/1955 | Kerr | 57/16 |
| 3,035,395 | 5/1962 | Bohannon | 57/18 |
| 3,304,705 | 2/1967 | Rathje et al. | 57/18 |
| 3,943,689 | 3/1976 | Kunz et al. | 57/93 X |
| 4,197,696 | 4/1980 | Bock | 57/18 |
| 4,254,615 | 3/1981 | Adolf et al. | 57/93 X |
| 4,470,248 | 9/1984 | Nortenius | 57/18 |
| 4,782,565 | 11/1988 | Sheehan | 57/264 X |
| 4,807,430 | 2/1989 | Palmer | 57/18 |
| 4,987,734 | 1/1991 | Meyer | 57/100 |

FOREIGN PATENT DOCUMENTS

| | | | |
|---|---|---|---|
| 695986 | 8/1940 | Fed. Rep. of Germany | 57/93 |
| 2204332 | 11/1988 | United Kingdom | 57/18 |

*Primary Examiner*—Stanley N. Gilreath
*Assistant Examiner*—Michael R. Mansen
*Attorney, Agent, or Firm*—Beveridge, DeGrandi, Weilacher & Young

[57] ABSTRACT

A control apparatus for yarn twisting machines includes a control panel provided with electrical devices for setting the speed of the units for feeding, taking up and winding up of the yarn. The electrical devices are provided on one side of a control panel and are aligned with respective digital displays, and with relative symbols indicative of the arrangement of the various working units of the twisting machine. A main control device enables all of the working units to be set simultaneously, while leaving the relative speed ratios unchanged.

6 Claims, 2 Drawing Sheets

YARN TWISTING MACHINE CONTROL APPARATUS HAVING A SIMPLIFIED CONTROL PANEL AND A YARN TWISTING MACHINE EQUIPPED THEREWITH

BACKGROUND OF THE INVENTION

The present invention relates to a control apparatus for yarn twisting or wrapping machines and the like, and in particular concerns an apparatus provided with electrical or electronic devices for setting the speed of the individual working units for supplying, taking-up and winding-up the yarn in each working section of the twisting machine, by means of which it is possible to provide a continuous and immediate indication of the various working speeds correlated to a working diagram illustrating the various units of the working sections of the twisting machine being monitored.

As is known for example from U.S. Pat. No. 4,197,696, in a yarn twisting or wrapping machine, the core yarn is unwound from a bobbin is supplied through one or more hollow spindles so as to be covered with at least one covering yarn and is then taken up and rewound onto a spool. The textile machine usually is provided with several twisting or wrapping sections, in which each section comprises superimposed working units such as a bobbin for supplying the core yarn, the spindle for the strand or covering yarn spindles, the take-up rollers, a yarn guide means which ensures distribution on the upper winding-up spool and the winding-up spools themselves which are actuated by separate control motors which must be suitably controlled and regulated so as to obtain the correct working speeds for supplying, wrapping, taking-up and winding the yarn, in accordance with the characteristics of the machine and the yarns used.

In the case of twisting or wrapping machines of the abovementioned kind, there exists the need for a device for controlling and setting the speeds of the various working units of the machine, by means of which the operator is able to obtain an immediate visual and related indication of both the speed which has been set and the unit being monitored, by operating control knobs. Therefore the main object of the invention is to provide a control apparatus for the above referred purpose.

A further object of the present invention is to provide a control apparatus for twisting machines, as mentioned above, which, in addition to allowing the speed of the individual unit of the machine to be adjusted, also allows the machine as a whole to be controlled by operating a single main control device, while leaving unchanged the relative speed ratios of the working units being monitored.

SUMMARY OF THE INVENTION

All of the above can be obtained by means of a control apparatus for twisting or wrapping machines of the type comprising working sections having correlated working units for unwinding a core yarn from a respective yarn delivering bobbin, respectively for feeding a strand or covering yarn to be wrapped around said core yarn passing through at least one hollow spindle rotatably supporting a spool of said strand, as well as for picking and reciprocally distributing said core yarn wrapped by said strand onto a winding-up spool. Each of said working units is connected to a respective drive motor and manually operable control means to regulate the speed of said drive motor. The apparatus comprises a control panel, a set of potentiometric control devices aligned and operable on said panel with control devices being connected to settable feeding circuits for said drive motors, display means to indicate working data of said unit with said display means being aligned on said control panel alongside a respective control device, and graphical symbols representing said working units on said panel, said graphical symbols being aligned alongside a respective display means.

BRIEF DESCRIPTION OF THE DRAWINGS

The apparatus for controlling twisting machines according to the present invention will be illustrated in greater detail hereinbelow with reference to the accompanying drawings in which.

DESCRIPTION OF THE INVENTION

Figure 1:
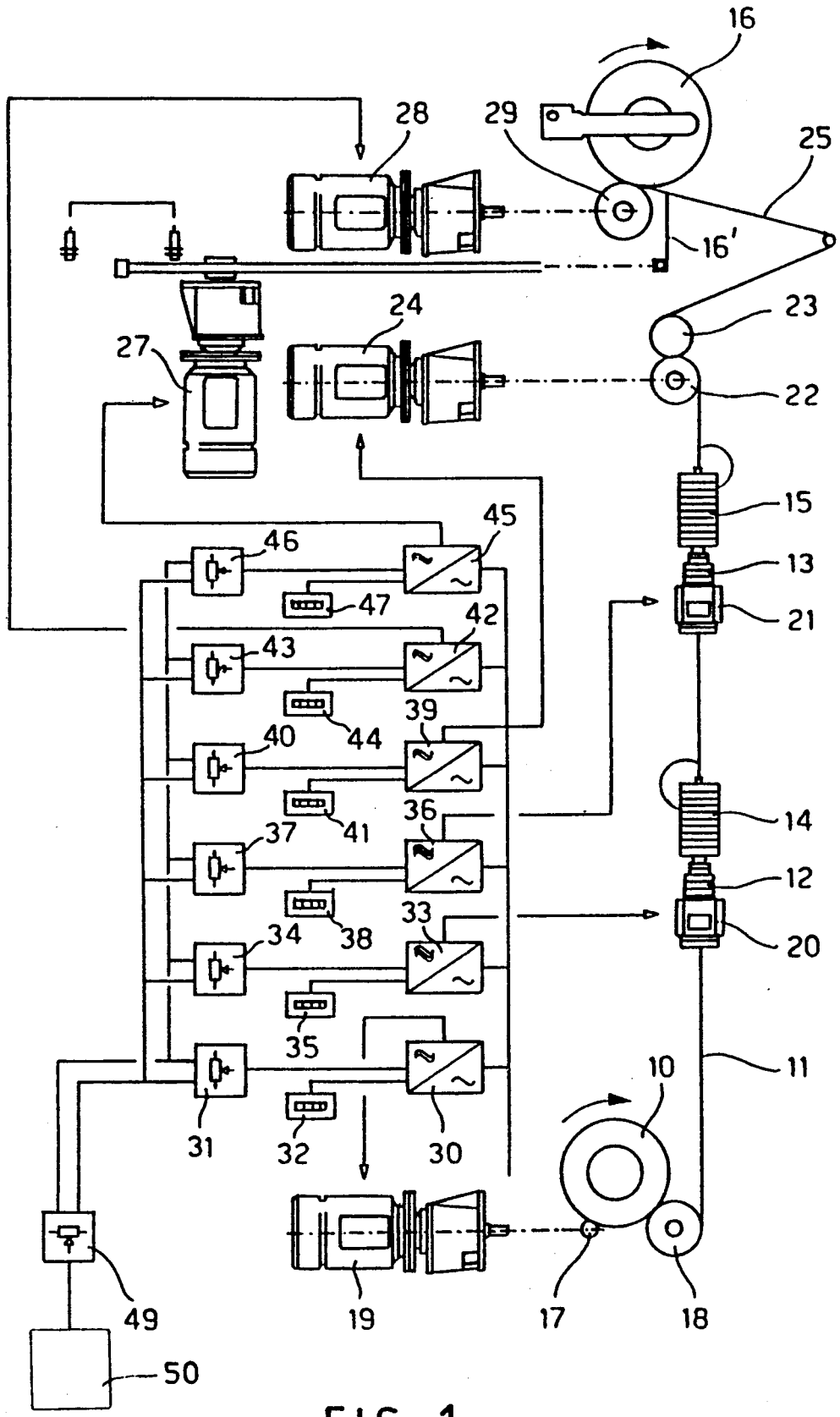
FIG. 1 is a general diagram of the apparatus.

As shown in FIG. 1, a twisting machine in general comprises, in each working section, a bobbin 10 from which a core yarn 11 to be covered, is unwound and is fed through one or two hollow spindles 12, 13 so as to have spirally wound around it a covering yarn or strand unwound from spools 14, 15 provided on the above mentioned spindles 12 and 13; the covered yarn 25 is then taken-up by rollers 22, 23 and wound onto an upper take-up spool 16.

The lower bobbin 10 containing the core yarn to be covered is designed and made to rotate to feed the core yarn at a predetermined supply speed, by means of rollers 17, 18, the roller 17 being suitably connected to a control motor 19. Similarly, in a manner known per se, the spindles 12 and 13 of the machine are respectively made to rotate at predetermined speeds by means of a tangential belt control device 20 and 21, connected to respective control motors.

The covered yarn 25 leaving the upper spindle is taken up by a pair of rollers 22, 23, the lower one 22 being similarly connected to a respective control motor 24. The covered yarn 25, which must be wound onto the upper taking-up spool 16, is distributed moreover uniformly on the latter by means of a yarn guide 26 made to reciprocate by a drive motor 27, while 28 denotes the motor operating the roller 29 which rotationally drives the taking-up spool 16.

Figure 2:
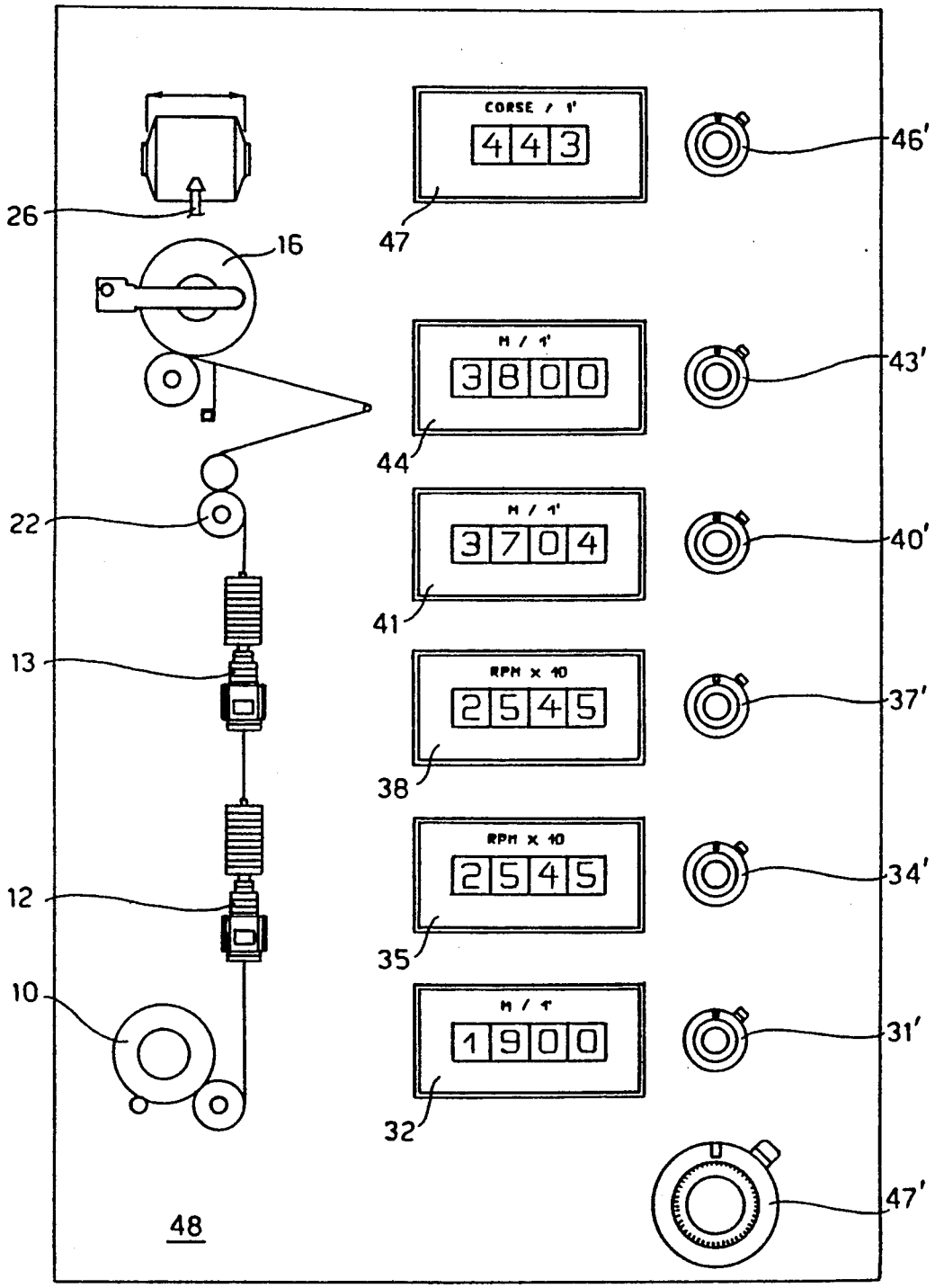
FIG. 2 is a view of the control panel.

Each drive motor of the twisting machine may be set so as to vary the working speed, i.e. the speed at which the yarn is supplied, drawn and taken-up by spools 16, in accordance with the functional and constructional characteristics of the machine, as well as in accordance with the characteristics of the same yarn. Each motor is of the asynchronous type and regulation of its rotational speed may be obtained by simply setting the value or the frequency of the electrical power source 50. This may be achieved for example by supplying power to each individual motor via a continuously settable power inverter or frequency converter comprising a respective potentiometric control device provided on a main control panel 48 shown in FIG. 2.

In particular, as shown, the motor 19 driving the rollers for unwinding the core yarn 11 is powered via an inverter 30 which can be set by means of a potentiometric circuit 31, while 32 denotes a digital display connected to an output of the inverter 30 capable of supplying a signal providing a numerical indication or data indicative of the speed at which the yarn 11 is supplied.

Similarly, 33, 34 and 35; 36, 37 and 38; 39, 40 and 41; 42, 43 and 44; and 45, 46 and 47 indicate respectively the power inverters, the potentiometric adjusting devices and the digital displays for indicating the number of revolutions of the spindles 12, 13, the taking-up speed, the number of reciprocations of the yarn guide 26 and the speed at which the yarn is wound on the upper spool 16.

Finally, 49 in FIG. 1 denotes a main potentiometric device from which supply power supply for the potentiometric devices 31, 34, 37, 40, 43 and 46 is obtained, so as to allow single setting of all the working units of the machine, while keeping the relative speed ratios unvaried.

According to the present invention as shown in FIG. 1, the various potentiometric devices 49, 31, 34, 37, 40, 43 and 46 can be actuated from a main panel 48 via respective control knobs 49', 31', 34', 40', 43' and 46' aligned along one edge of the panel. Alongside each knob controlling the potentiometric devices 31, 34, 37, 40, 43 and 46, on the same panel 48 there are provided respective displays 32, 35, 38, 41, 44 and 47, each having alongside it a graphical symbol of the corresponding working unit of the machine being monitored, as per the diagram shown on the opposite side of the panel in the same FIG. 2. The graphical symbols include a symbol representing bobbin 10, spindle 12 (along with the belt control device and the spool which correspond to spindle 12), spindle 13, (together with the belt control device and spool associated with spindle 13), roller 22, covered yarn winding spool 16, and yarn guide 26. The graphical symbols also show the core yarn (identified by 11 in FIG. 1) as extending between the different working units according to the interrelationships between the working units.

In this way the operator is able to obtain an immediate indication by which it is possible to correlate both the working data and the symbol of the working unit which he is monitoring.

This arrangement, on a common panel, of the potentiometric devices for regulating the motors, and the displays showing the yarn supply speed and taking up speed as well as the rotational speed of the spindles, in combination with a graphic representation of the individual units monitored, greatly aids the operator in that it provides a direct visual indication, in the form of symbols, of each group being monitored. In this way, the twisting machine is provided with a control panel which is extremely simple and practical in use, something which is not possible with other previously known computerized or electrical control systems, and all at a considerably lower cost.

What is claimed is:

1. A control apparatus for a twisting machine of the type comprising working sections having working units for (a) unwinding a core yarn form a yarn delivering bobbin, (b) feeding a strand for wrapping said strand around the core yarn as said core yarn passes through at least one hollow spindle which rotatably supports a spool having the strand, and (c) for picking and reciprocally distributing the core yarn, after it has been wrapped by the strand, onto a winding-up spool, each of the working unit being connected to a respective drive motor and a feeding circuit for driving each respective drive motor, the control apparatus comprising:

a control panel, a plurality of potentiometric control devices aligned and operable on the panel, the control devices each being connected to one of the feeding circuits for regulation thereof to thereby regulate the speed of the associated drive motor;

display means to display data indicative of operation of the unit, the display means being aligned on the control panel alongside a corresponding one of the control devices, and graphical symbols representing the working units on the panel, the graphical symbols being aligned alongside a corresponding one of the display means, the graphical symbols including a first symbol depicting at least one working units for unwinding a core yarn from a yarn delivering bobbin, a second symbol depicting at least one working unit for wrapping said strand around the core yarn as said core yarn passes through at least one hollow spindle, a third symbol depicting at least one working unit for picking and reciprocally distributing the core yarn, after it has ben wrapped by the strand, onto a winding-up spool, and a symbol representing the core yarn, the core yarn symbol extending between each of the first, second and third symbols corresponding to the interrelationship of the working devices in the twisting machine.

2. A control apparatus according to claim 1, in which power to each of the potentiometric control devices is controlled by a main potentiometric device.

3. A control apparatus according to claim 1, wherein the graphical symbols include the core yarn symbol extending form a symbol for a bobbin, to symbols for a first belt control device and spindle and spool arrangement, to symbols for a second belt control device and spindle and spool arrangement, to a symbol for a roller, and to a symbol for a covered yarn winding spool.

4. A controllable twisting machine comprising:

working sections having working units which unwind a core yarn from a respective yarn delivering bobbin, feed a strand which wraps the core yarn s the core yarn passes through a hollow spindle, and after wrapping by the strand, pick and reciprocally distribute the core yarn onto a winding-up spool, the working units being driven by drive motors;

feeding circuits associated with each drive motor for driving the drive motors, a control panel, a set of potentiometric control devices aligned and operable on the panel, each of the control devices being connected to one of the feeding circuits for regulation thereof to thereby regulate the speed of the associated drive motor;

display means to display data indicative of operation of the unit, the display means being aligned on the control panel alongside a corresponding one of the control devices, and graphical symbols on the control panel for representing the working units, the graphical symbols being aligned alongside a corresponding one of the display means, the graphical symbols including a first symbol depicting at least one working unit for unwinding a core yarn from a yarn delivering bobbin, a second symbol depicting at least one working units for wrapping said strand around the core yarn a said core yarn passes through at least one hollow spindle, a third symbol depicting at least one working unit for picking and reciprocally distributing the core yarn, after it has been wrapped by the strand, onto a winding-up spool, and a symbol representing the core yarn, the core yarn symbol extending between each of the first, second and third symbols corresponding to the interrelationship of the working device sin the twisting machine.

5. A twisting machine according to claim 4, in which power to each of the potentiometric control devices is controlled by a main potentiometric device.

6. A twisting machine according to claim 4, wherein the graphical symbols include the core yarn symbol extending from a symbol for a bobbin, to symbols for first belt control device and spindle and spool arrangement, to symbols for a second belt control device and spindle and spool arrangement, to a symbol for a roller, and to a symbol for a covered yarn winding spool.

* * * * *